United States Patent [19]

Wallace

[11] 4,041,875

[45] Aug. 16, 1977

[54] ADJUSTABLE SINGLE-BEAM GANTRY

[75] Inventor: Bernard E. Wallace, Exton, Pa.

[73] Assignee: B. E. Wallace Products Corporation, Malvern, Pa.

[21] Appl. No.: 604,682

[22] Filed: Aug. 14, 1975

[51] Int. Cl.[2] ..... E01B 23/00

[52] U.S. Cl. ..... 104/126; 212/13

[58] Field of Search ..... 104/126; 212/13; 52/645, 646; 248/165; 403/4, 49; 182/153, 155, 184, 185

[56] References Cited

U.S. PATENT DOCUMENTS

| | | | |
|---|---|---|---|
| 1,725,168 | 8/1929 | Willis | 182/184 X |
| 2,436,337 | 2/1948 | Smith et al. | 104/126 |
| 2,990,788 | 7/1961 | Wallace | 104/126 |
| 2,995,094 | 8/1961 | Wallace | 104/126 |
| 3,490,385 | 1/1970 | Gibbins et al. | 104/126 |
| 3,826,196 | 7/1974 | Wallace | 104/126 |

FOREIGN PATENT DOCUMENTS

| | | | |
|---|---|---|---|
| 1,242,098 | 8/1960 | France | 212/13 |

*Primary Examiner*—Robert J. Spar
*Assistant Examiner*—Randolph A. Reese
*Attorney, Agent, or Firm*—Synnestvedt & Lechner

[57] ABSTRACT

A load-handling gantry having a single, unitary, bridging beam, and leg, brace and mounting components supporting the beam with provision for adjustment of gantry span, height, and spread, while maintaining gantry mobility. The mounting components are adjustable to enable use of the gantry in a number of configurations including inboard, outboard, and combination leg bracing, and with freedom for use under cantilever conditions. In the preferred embodiment, a predetermined camber, or longitudinal splay angle, of the plane of each pair of legs is provided, to decrease movement between the gantry legs and the beam, in the direction lengthwise of the beam, when the gantry is under load, thereby stabilizing the gantry in that sense. The selected splay angle is maintained by apparatus which couples the leg bracing struts to the beam and to the legs. Any selected angle, under the various arrangements of leg bracing, may be had, and may be maintained, by such coupling apparatus, which provides alteration of the effective bracing strut length, without the necessity of actually substituting struts of different lengths. Lateral clearance between the beam, and the legs and bracing struts, is maintained in the various configurations, at a value such as to permit free movement of the leg and strut assemblies along the length of the beam, and also a measure of lateral flexibility of the gantry. All adjustments relative to the beam may be made through external frictional gripping apparatus, cooperable with a standard imperforate beam.

12 Claims, 20 Drawing Figures

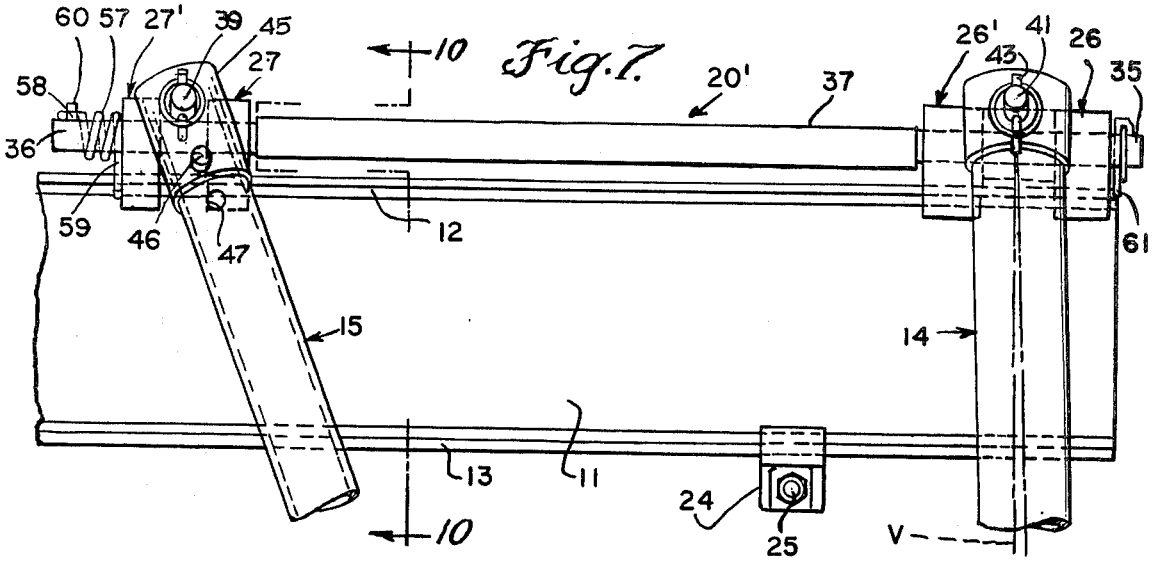
Fig. 7.
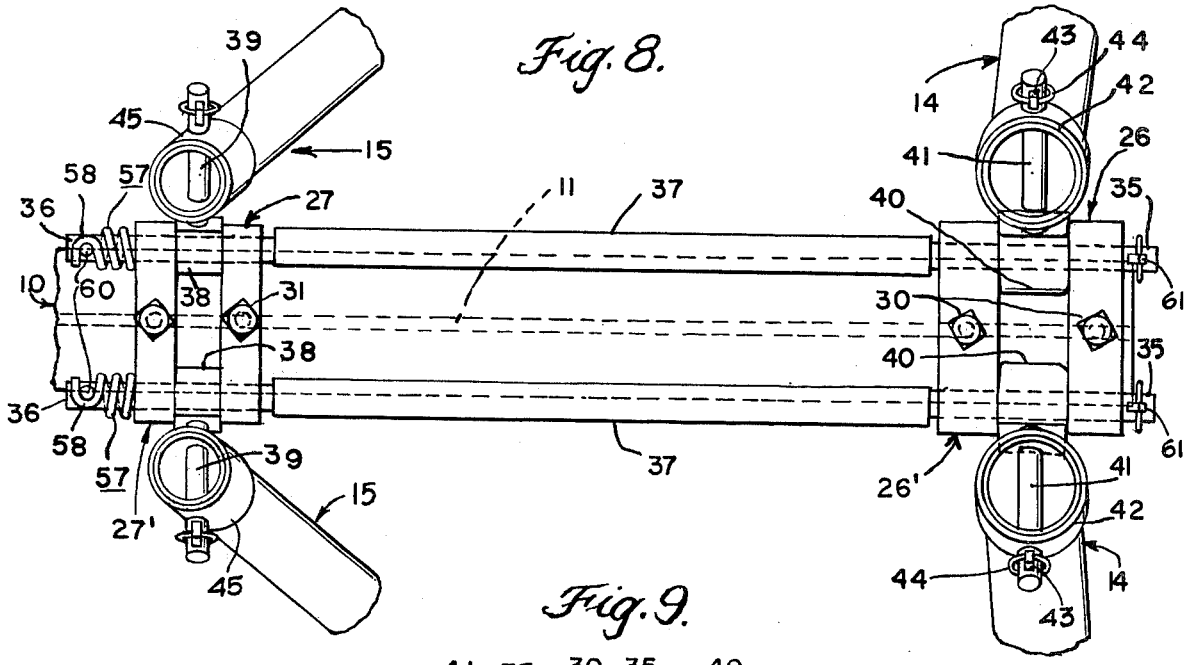
Fig. 8.
Fig. 9.
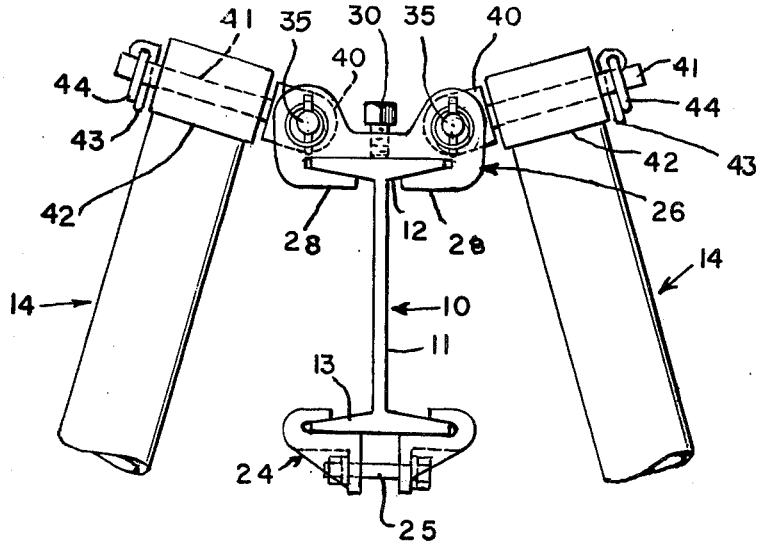

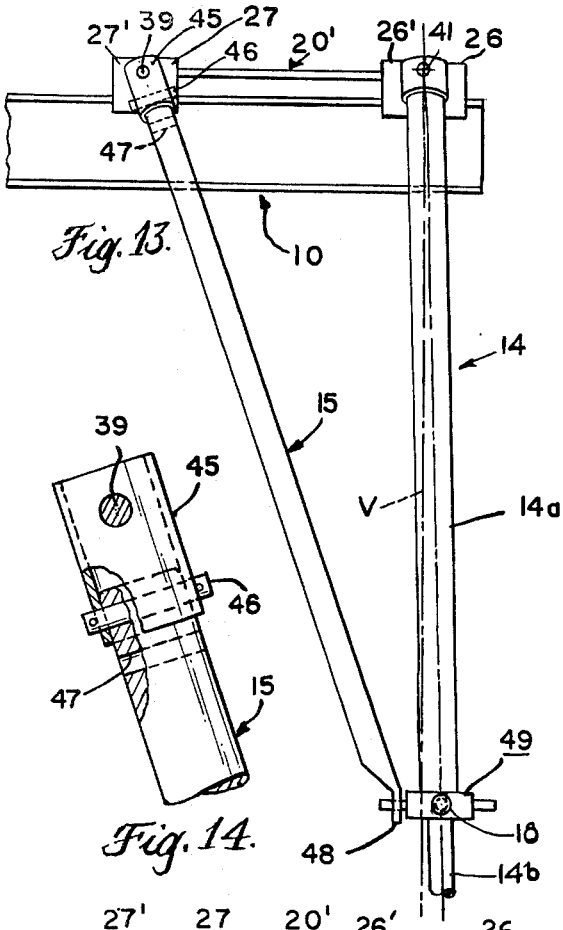
Fig. 13.
Fig. 14.
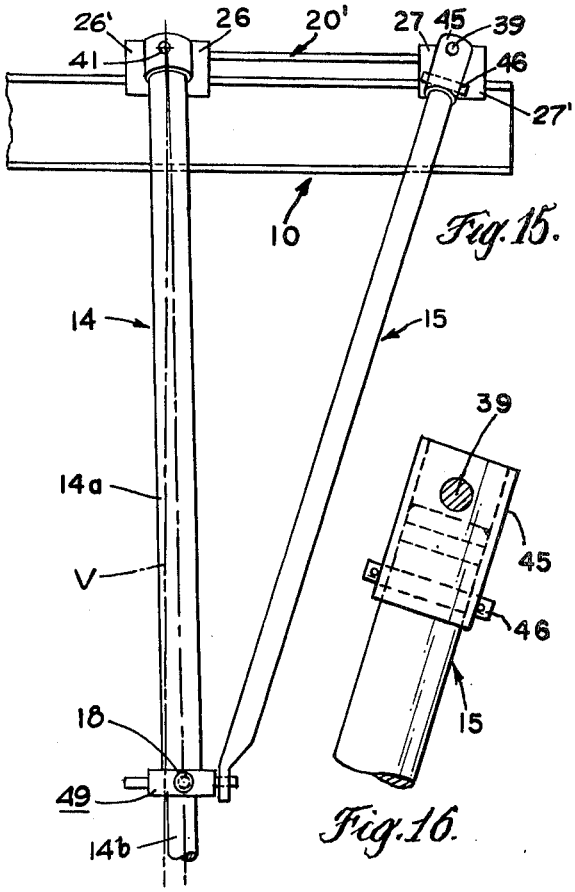
Fig. 15.
Fig. 16.
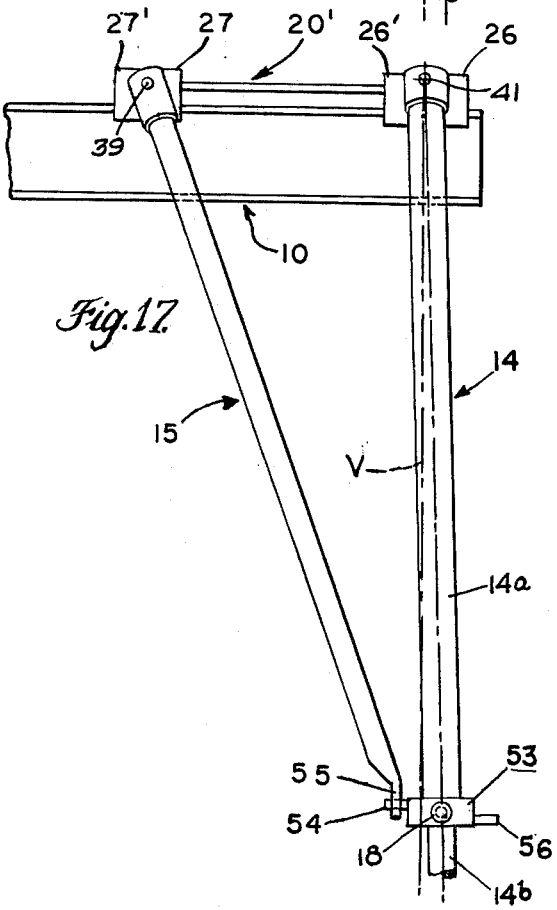
Fig. 17.
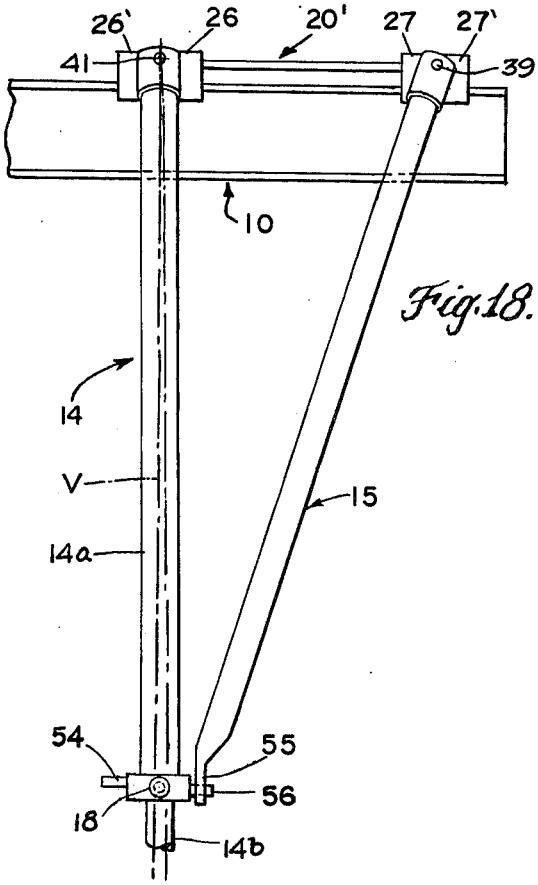
Fig. 18.

ADJUSTABLE SINGLE-BEAM GANTRY

BACKGROUND OF THE INVENTION

My invention relates to load-handling gantries of the type having a load-carrying member, such as a bridging I-beam, which is supported at longitudinally spaced stations by pairs of braced and variably divergent legs. The legs and braces are associated with the upper flange of the I-beam, and its lower flange commonly carries a trolley from which a load may be movably suspended and may be raised and lowered by a hoist or the like.

The development of several prior gantries is typified by U.S. Pat. Nos. 2,990,788, 2,995,094, 3,490,385 and 3,826,196, granted, respectively, on July 4, 1961, Aug. 8, 1961, Jan. 20, 1970, and July 30, 1974. These gantries provide features of adjustability, including variation in leg length and divergence; and one patented embodiment, because of the use of a main I-beam in conjunction with a pair of auxiliary I-beam sections, is usable in a variety of configurations including what has become known as inboard, outboard, and combination leg bracing. Also, because of its triple I-beam, this patented construction has afforded adjustability of gantry span, and provision of beam overhang.

In brief, those earlier patented gantries have, individually, various features of adjustability, and utility in various configurations. However this has not been achieved without acceptance of a number of shortcomings, principally in that, to realize the greatest adjustability, it has been necessary to accept a three-part bridging beamm structure, and to aperture both the web and flanging to accept movable mounting bolts.

A further shortcoming was the loss of headroom due to the double I-beam used. A still further disadvantage came from the added weight of the extra I-beam members. A further disadvantage was the added cost due to the extra I-beams and related hardware, which sometimes increased the cost of gantries by 20% to 30%.

SUMMARY OF THE INVENTION

It is the general object of the present invention to achieve all of the different adjustments, including usability in all of the various configurations of which the aforementioned previous gantries were capable, collectively.

In the achievement of this broad purpose, I utilize only a single, unitary, beam, which has no bolt perforations in any part thereof.

My apparatus is featured by the unusual ease with which it may be adjusted from one configuration to another, and by substantially less weight, lower cost, and greater portability, for a given load rating.

Not only does this improved gantry provide complete adjustability, as to: height; spread; beam span; portability; and the different bracing configurations, and combinations thereof; but is also provides the desired degree of lateral flexibility and at the same time vertical centering of the beam web when not loaded; and also that degree of leg splaying found desirable, e.g., about 1.5° divergence of legs from the vertical. The splaying is readily maintained during adjustments of the legs, and under different leg brace configurations.

More specifically, the gantry of the present invention provides such clearance between the beam, and its supporting legs and struts, as to permit location of the leg assemblies at any selected stations along the beam, a feature which contributes substantially to the freedom to use a single, unitary beam.

BRIEF DESCRIPTION OF THE DRAWINGS

In the accompanying drawings:

FIG. 7 is an enlarged, elevational, view of the upper portion of the right hand leg and brace of FIG. 1;

FIG. 8 is a plan view of the apparatus of FIG. 7;

FIG. 9 is an end view of the apparatus of FIG. 7, as viewed from the right in FIG. 7;

FIG. 13 is an assembly view of the right hand leg and inboard brace member of FIG. 1, but on a larger scale than FIG. 1;

FIG. 14 is an enlarged detail view of an adjustable sleeve device as it is employed in the apparatus of FIG. 13;

FIG. 15 is an assembly view of the right hand leg and outboard brace member of FIG. 2; on the scale of FIG. 13;

FIG. 16 is an enlarged detailed view of the adjustable sleeve device as it is employed in the apparatus of FIG. 15;

FIG. 17 shows a modified form of inboard leg bracing, employing at the bottom of the brace member, a collar having displaced, or staggered, pinning points, whereby to provide for varying the effective length of the brace;

FIG. 18 is a view similar to FIG. 17, but illustrating the brace adjusted for outboard bracing;

DESCRIPTION OF REPRESENTATIVE EMBODIMENTS

Figure 1:
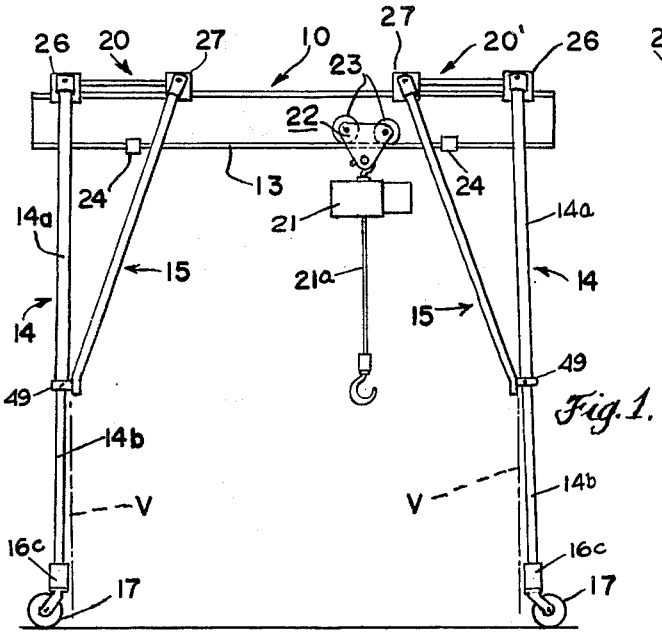
FIG. 1 is a somewhhat schematic, side elevational view of a gantry embodying the invention, with the legs and braces adjusted to provide what may be termed standard inboard bracing.

With more detailed reference to the drawings, and initially to FIGS. 1 to 6, it will be seen that the gantry comprises a single, unitary, imperforate, load-carrying member, or bridging beam 10. Preferably, and as shown, this bridging beam comprises a steel I-beam having a web 11, which is disposed generally vertically, when the gantry is erected for use, and upper and lower horizontal flanges 12 and 13, respectively (see particularly FIGS. 9 and 10). Legs 14, also preferably of steel, are disposed in pairs which straddle the width of the beam, each leg extending outwardly and diverging laterally downwardly from the beam, as clearly appears in FIGS. 7 and 9. Each pair of legs, and their mounting and coupling apparatus, including their individual leg bracing members, or struts 15, comprise a braced beam support means, and the supports provided by the two pairs of legs are each arranged at a station. The support means of apparatus at each of the stations, which are spaced-apart along the beam, are identical and a description of one support means may be taken as typical of both. Each leg of each pair comprises two telescopic sections. These are upper and lower sections when the gantry is in use, and they are identified at **14*a* and 14*b* in FIGS. 1, 6, 19 and 20. A telescopic tie-rod 16, of tubes 16*a* and 16*b*, adjustably interconnects the lower leg sections 14*b* of a pair; and casters 17, desirably lockable (by means not illustrated), are disposed, one beneath each leg, and each caster is swivellable about an upright axis mounted in a bracket 16*c***. The casters provide for ready portability and maneuvering of the gantry.

Figure 19:
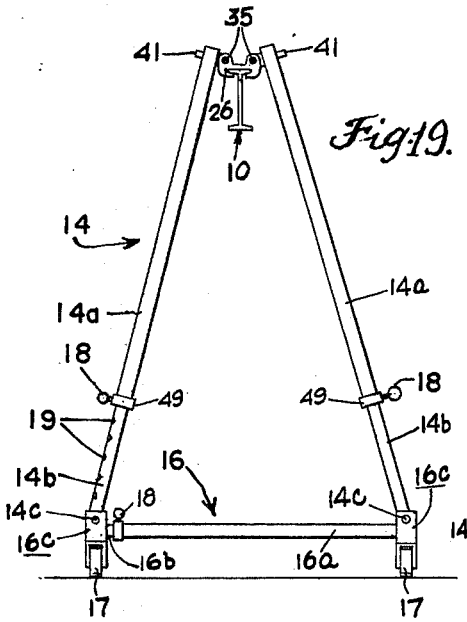
FIG. 19 is a somewhat diagrammatic view, similar to FIGS. 1 to 6, illustrating the gantry adjusted for maximum height and minimum spread.
Figure 20:
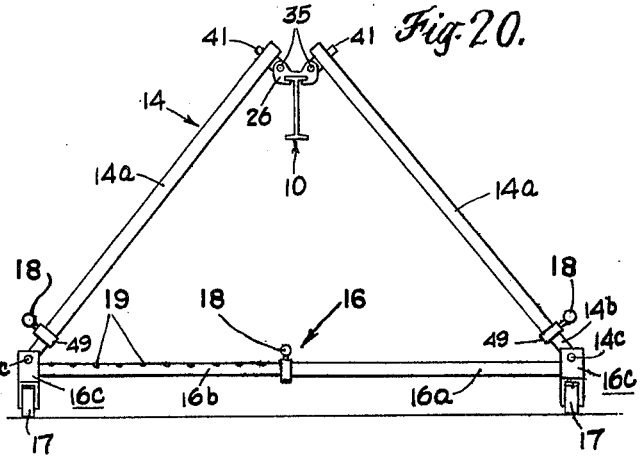
FIG. 20 is a similar view showing the gantry adjusted for minimum height and maximum spread.

As shown in FIGS. 19 and 20, the gantry is adjustable as to height and spread, and pins 18 carried by collars 49 fixed to the upper leg sections **14*a*, are cooperable with apertures 19 to secure the telescopic leg sections in the various desired positions; while similar pins 18 are cooperable with similar apertures 19 to secure the tie-rod sections 16*a* and 16*b*** in their various positions of adjustment. Other parts involved in this assembly will be referred to hereinafter.

As noted early in this specification, the gantry is usable in a wide variety of configurations, and degrees of span, several of the more basic being shown in FIGS. 1 to 5. Mounting assemblies and coupling means are provided which make it a very simple matter to achieve the various adjustments of which the gantry is capable. These assemblies and means will be described in detail below, and for the present it is only necessary to point out that the legs 14 and their bracing struts 15 are so associated with one or the other of identical left and right-hand mounting asemblies, designated generally at 20 and 20', as to have ample freedom for movement to different stations along the beam 10, and that the legs and struts are pivotally coupled to their mounting assemblies with freedom for pivotal movements in planes transverse the length of the beam.

Apart from variations in height, spread, and use of the gantry under conditions of uneven leg extension, and the like, some of the various basic use configurations clearly appear from inspection of FIGS. 1 to 5, and 19 and 20.

In FIG. 1 the gantry is illustrated, somewhat schematically and inside elevation, with its legs 14 and struts 15 adjusted to provide what has been known as inboard bracing, that is, bracing in which the struts are disposed along the bridging beam inside, or "inboard", of the legs. This affords maximum leg spacing.

Figure 2:
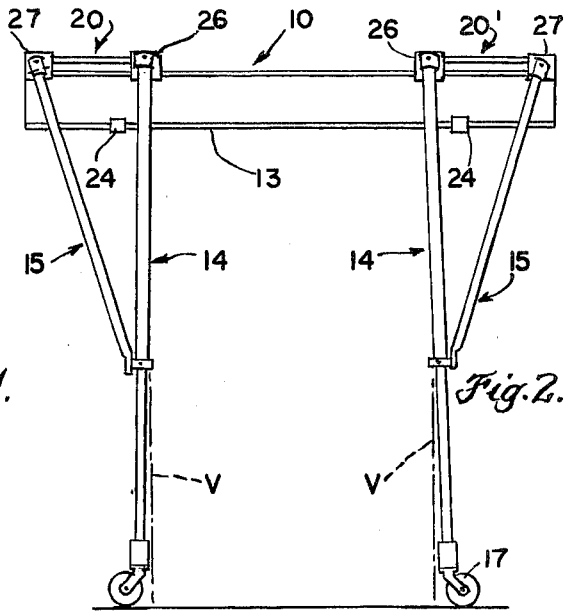
FIG. 2 is a similar side elevational view with the legs and braces adjusted to provide outboard bracing.

FIG. 2 shows the gantry with its legs disposed somewhat closer to the beam center and the struts 15 arranged for what will now be understood to be outboard bracing.

Figure 3:
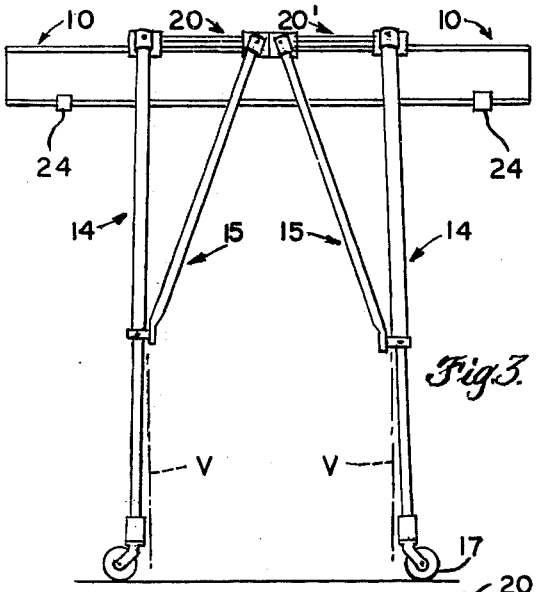
FIG. 3 is a side elevational view with the legs braces adjusted to minimize the span between leg assemblies.

FIG. 3 shows the gantry in the configuration which afford minimum spacing between the braced legs 14. Inboard bracing is usually used under this condition since it eliminates the possibility of having legs 15 so close together as to result in instability. It should be noted that the configurations shown in FIGS. 2 and 3 are both useful where there is limited clearance available for the legs, in the direction of beam length.

Figure 4:
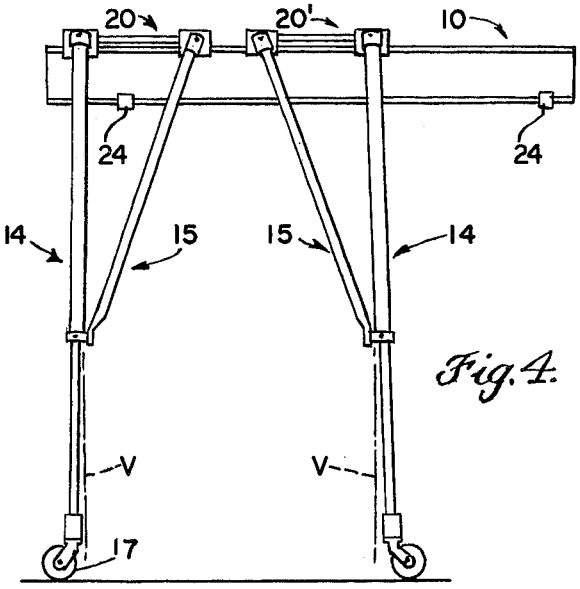
FIG. 4 is a similar view depicting a cantilever beam arrangement.

FIG. 4 shows a variation of inboard bracing in which one leg pair is moved toward the center of the beam, with the result that the beam may be used in cantilever. This configuration is useful in a number of situations, for example when the gantry is used in removing objects from, or lowering them into, an excavation or other recessed area, pit, or the like.

Figure 5:
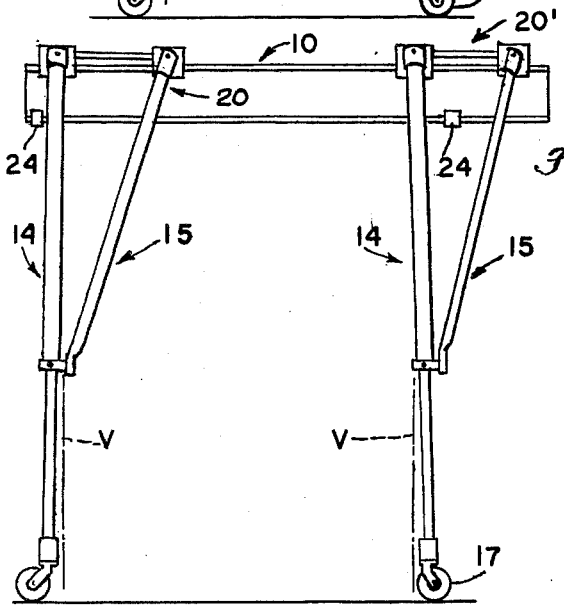
FIG. 5 is another schematic side elevational view showing a combination inboard and outboard bracing arrangement.
Figure 6:
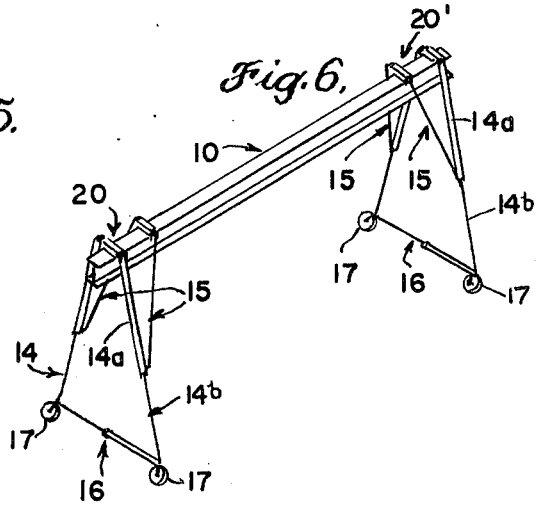
FIG. 6 is a schematic, isometric, overall view of the gantry.

FIG. 5 further illustrates the versatility of my gantry, which is there illustrated under a condition known as combination leg bracing (one brace inboard, one outboard).

Significantly, all of these basic configurations, as well as quantitative variations of each, are readily achieved by the use of a single beam from which the legs and struts have adequate spacing laterally of the beam.

It will also be observed that, in each configuration, the desirable small camber, or outward splay angle (in the illustrated apparatus about 1.5° ), is present, as is indicated in the figures by the vertical line V with respect to which each leg has the mentioned, slight, outward angularity in the direction of the length of the beam. Such camber, while not essential, has a desirable stabilizing effect as explained in U.S. Pat. No. 3,490,385. It will be appreciated that the splay angle V is the angle between a vertical plane and the plane defined by a pair of legs 14. In the past, in order to maintain this angle, while using the same brace struts, it has been necessary to relocate the strut pivot point away from its normal pivot position, when the strut is disposed for outboard bracing, or to substitute struts of different lengths. In accordance with the present invention the required change in effective length of the strut is achieved by the use of very simple strut-coupling means described below.

In all configurations it is possible to suspend the weight from the beam 10, in any of several suitable ways. However, it is usually slung from a hoist 21, as by a cable or chain **21*a* (such as shown in FIG. 1), with such hoist attached to a trolley 22 whose wheels 23 ride on the upper surface of the lower flange 13 of the I-beam. Further description is not necessary herein, other than to point out that a pair of stops 24, 24 are spaced along the beam, being adjustably secured to the flange by a bolt 25, in a manner which will be understood by inspection of FIG. 9. For simplicity in illustration, the trolley has been shown only in FIG. 1. However, comparisonn of FIGS. 1, 3, 4, and 5** illustrates that some relocation of the trolley stops is desirable, in the different configurations, in order to insure stability of the gantry under load, and/or to take advantage of the available range of travel.

Figure 10:
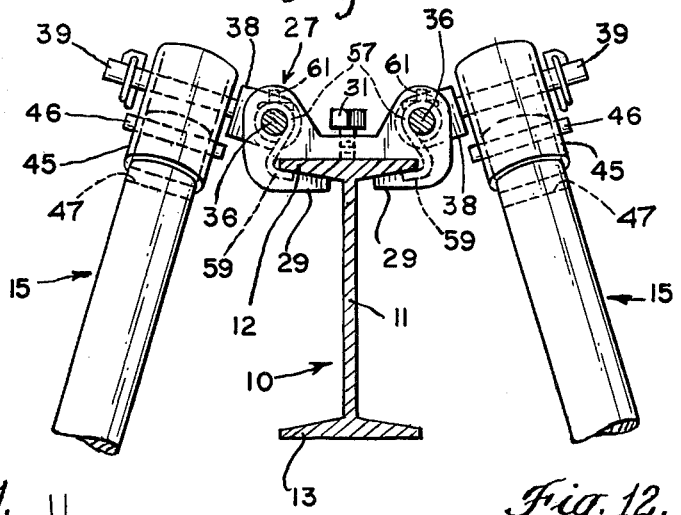
FIG. 10 is a cross-sectional view taken on the line 10—10 of FIG. 7, and looking toward the leg braces of FIG. 7.

A pair of identical mounting assemblies 20,20' are carried by the upper flange 12 of the I-beam, and, for ease in locating the parts between the several views of the drawing, the following should be considered as descriptive of the right-hand assembly 20', in the presently preferred configuration, which is herein described and illustrated. Each assembly includes mounting saddles, or clamping cross-ties disposed in pairs. Cross-ties 26 and 26' comprise the right-hand pair (FIGS. 7 and 8), while cross-ties 27 and 27' comprise the left-hand pair. The saddles formed by these two pairs are of similar construction, except that cross-ties 26, 26', to which the legs 14 are coupled, are of somewhat heavier construction than the cross-ties, 27, 27', to which the brace struts 15 are coupled. This difference shows to best advantage in FIGS. 7 and 8. Each saddle cross-tie has inwardly directed clamping ends seen at 28, 28 in saddles 26 and 26', and 29, 29 in saddles 27 and 27' (FIG. 10). The upper flange 12 of the I-beam is snugly received between these clamping ends of each saddle cross-tie, and it will be apparent that the spaced cross-ties can be slid along the I-beam to various locations (e.g. the locations shown in FIGS. 1 to 5), and fixed in any selected location by any convenient means which may take the form of the set screws 30 for each of cross-ties 26 and 26', and the similar set screws 31 for each of cross-ties 27 and 27'.

When viewed in plan (FIG. 8) it is seen that the cross-ties of each pair are spaced sufficiently to accommodate pin-carrying blocks, to be described in detail below. Each cross-tie is drilled to accommodate the reduced diameter extensions 35 and 36 which are provided on the opposite ends of each of a pair of spacer rods 37, 37, and which extensions pass through outboard portions of the cross-ties, when the latter are viewed in plan. When the parts are assembled, the rods 37, 37 overlie the upper flange 12 of the beam, and maintain the requisite spacing between the pair of leg-coupling cross-ties 26, 26' and the pair of the strut-coupling cross-ties 27, 27'. The entire assembly may be readily repositioned along the beam, it being necessary of course to loosen the set screws 30 and 31. With the parts assembled as shown in FIGS. 7 to 10, that is, for inboard bracing, nothing further need be done. The beam end is shown on the right side of FIGS. 7 and 8, and if outboard bracing is required at that beam end, it is necessary to switch the positions of the cross-tie pairs on the beam.

Means is provided to couple the upper ends of the struts and legs to their respective saddle structures, and to couple the lower ends of each strut to the leg it braces. Considering first the coupling to the saddle cross-ties of the mounting assemblies, and with exemplary reference to assembly 20', as shown in FIGS. 7 to 10, it will be observed that each cross-tie pair has therebetween the above mentioned pin-carrying blocks. Each block is rotatively mounted on an end extension of a corresponding spacer rod 37. Thus, between the cross-ties 27, 27', there are a pair of blocks 38, 38 each of which carries a pivot pin 39, swingable with the block to a position so angled as to receive its strut 15. Similarly, between the cross-ties, 26 and 26' are swingable blocks 40, 40 each of which has a pivot pin 41 to mount its asssociated gantry leg 14. Each of the legs 14 has as its upper end a ferrule 42, fixedly associated with the top of the leg, and having oppositely positioned, confronting apertures through which projects the pin 41 (see particularly FIGS. 8 and 9). As best shown in FIG. 9, the pivot pins each have a transverse bore through which extends the short locking pin 43 of a known securement device which includes a wire loop 44 pivoted in the pin 43 and swingable to a position in which it is looped around pivot pin 41, and prevents accidental dislodgement of the locking pin 43. When the legs are coupled to the pins 41, 41, they may be swung on blocks 40 about axes provided by extensions 35 until they assume any desired lateral spread, between the limits shown in FIGS. 19 and 20. To accommodate such motions (or adjustments) of the legs 14 about axes 35, at blocks 40, the foot ends of the legs are pivoted at **14*c* to the brackets 16*c* to which the cross-tie 16 is secured. It should also be noted that the casters 17 have vertical pivot axes in the respective brackets 16*c***. These axes remain parallel, under all leg adjustments.

A special feature of the embodiment shown in detail in FIGS. 7 to 10, as well as schematically in FIGS. 1 to 5, involves the manner in which the bracking struts 15 are coupled to the mounting assemblies, with freedom for adjustment of the effective length of each strut when it is changed from inboard to outboard bracing. As appears very clearly in FIGS. 7, 10, 14 and 16, the top of each strut, in this embodiment, has a ferrule or cap 45 which is slidably mounted on the strut 15. Each cap 45 is apertured to receive the strut pivot pin 39, which is preferably secured by locking pins of the kind already described with respect to coupling of the legs 14. Each cap is also apertured to receive a cross-pin 46 which extends through an upper hole in the strut (FIGS. 10 and 14), when inboard bracing is desired. Each strut also has a lower hole, or bore, 47 through which cross-pin 46 extends (FIG. 16) when the effective length of the strut must be shortened to maintain the splay angle under conditions of outboard bracing. Any suitable means may be used to hold the cross-pin 46 releasably in the selected cross aperture of the strut. The lower end of the strut 15 has a flatted portion 48 pinned to the collar or ring 49 fixedly carried by the lower end of the upper telescopic leg section **14*a*, and apertured to receive the leg adjusting pins 18**, as described above.

The manner in which this strut-coupling apparatus functions can be appreciated by comparing the adjustments for inboard bracing, shown in FIGS. 13 and 14, with the position of the parts under outboard bracing, as shown in FIGS. 15 and 16.

Two modified arrangements for adjusting the effective length of the struts are also shown. In each of these the cap is fixed to the top of the strut and the strut adjustment is effected at the bottom thereof.

Figure 11:
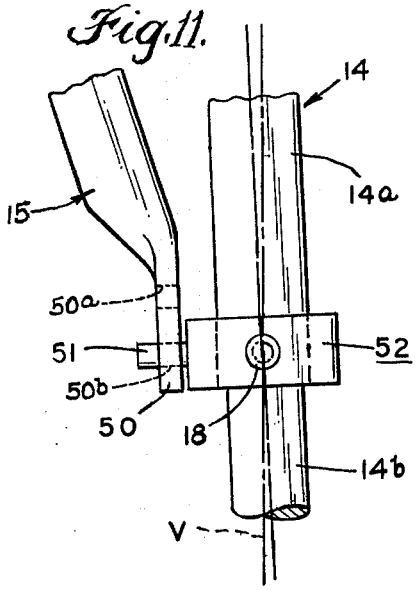
FIG. 11 is a fragmentary view illustrating a modification in which spaced adjusting holes are provided at the lower end of the brace to cooperate with a pin of a collar fixedly carried by one leg section, whereby to vary the effective length of the brace.
Figure 12:
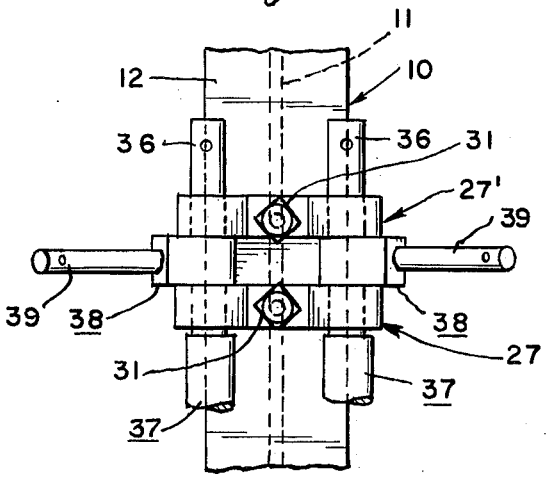
FIG. 12 is a detailed plan view of a clamp, or saddle, device for securing brace members to the I-beam.

In the modification shown in FIG. 11, for example, the flatted portion 50 of the strut is provided with upper and lower apertures **50*a* and 50*b*, either of which can cooperate with a pin 51 which projects laterally from the ring 52. As was the case with the first embodiment (with its ring 49), the ring 52 is fixedly carried by the lower end of the upper telescopic leg section 14*a*. Under inboard bracing shown in FIG. 11, the pin 51 is located in the lower aperture 50*b*. The upper aperture 50*a*** would be used when outboard bracing is desired, since the effective length of the strut must be shorter, in order to maintain the splay angle under such bracing.

FIGS. 17 and 18 illustrative yet another modification for coupling the lower end of the strut to the gantry leg, in such manner as to control the effective length of the strut in accordance with whether inboard or outboard bracing is desired. In this embodiment the ring 53 which is secureed to the lower end of the upper telescopic leg section has a pair of vertically displaced pins facing laterally of the ring in opposite directions. An upper pin 54 extends through the single aperture of the flatted portion 55 of the strut under the inboard bracing shown in FIG. 17, while the lower pin 56 cooperates with the aperture in the flatted portion when outboard bracing (FIG. 18) is desired. Under either adjustment, as has been the case with preceding embodiments, the desired small splay angle is maintained under both inboard and outboard bracing.

It is usually desirable that the beam be centered between the supporting legs under the no load condition, that is, that the web of the beam extend substantially vertically, forming equal angles with the axis of the legs, as shown in FIG. 9. For this purpose, one reduced end portion of each of the spacer rods, as illustrated by the left hand end portions 36, 36 in FIGS. 7 and 8, are provided with special torsion springs which encircle end portions 36, and react between the beam and each of the spacer rods to apply an equal torque to each rod, in order to centralize the beam between the leg supports. This apparatus is best illustrated in FIGS. 7, 8 and 10, and it comprises a coil spring having a central portion 57 wrapped around the reduced rod extension 36, an outboard portion 58 which is associated with the spacer rod in a manner described just below, as well as an inboard terminal end 59 (FIG. 10) which extends downwardly, wraps under, and engages against the adjacent edge of upper flange 12 of the I-beam. The outboard end 58 is wrapped about a pin 60, fixed to the reduced portion 36 of the spacer rod (FIGS. 7 and 8), and it will be appreciated that the two similar springs exert substantially equal torsional force between the rods which carry the leg structure and the beam itself. This force is sufficient to center the beam in the desired fashion, when the beam is not under load. At the opposite end of the spacer rods, that is in the vicinity of reduced projections 35, 35, disassembly of the apparatus is prevented by utilizing a pin 61 which passes through an aperture provided in the extension 35.

From the foregoing description it will be understood that my improved gantry provides all the above-described features of adjustablility, including: variation in span between legs; variation in leg length and divergence; and usability in a variety of configurations, including conditions of both inboard and outboard bracing; and, at the same time, mobility of the gantry. It is significant that the high degree of adjustability of this gantry, is achieved by the use of a single unitary bridging beam, and that the apparatus is featured by the unusual ease with which it may be adjusted, by its substantially lower weight and consequent lower cost (which may be as much as a 30% saving), and by correspondingly greater portability.

In the foregoing description, and the accompanying claims, reference is made to certain elements as being upper or lower, or right-hand or left-hand, and the like. It should be understood, however, that such terms of spatial relationship are used as a matter of convenience only, and that such expressions merely indicate the location of the parts in normal use of the gantry.

I claim:

1. In a load-handling gantry, a single, unitary, bridging beam in combination with leg, brace, and mounting components so supporting said beam as to provide adjustment of gantry span, height, and spread, and use of the gantry in a number of leg and brace configurations, said components comprising: legs arranged in pairs with the legs of each pair spanning the beam, and extending downwardly and diverging laterally of the beam; a bracing struct associated with, and disposed to brace, each leg; a pair of rod-like mounting assemblies each supported directly upon said unitary bridging beam, movable along the beam to selected positions to vary the span between said assemblies, and including clamping means frictionally securing said assemblies in said positions; and means for coupling upper portions of the legs of each pair, and of the bracing struts for said legs, to a corresponding one of said assemblies, and establishing, between the coupled upper portions of each leg and its strut, a distance which is substantially fixed, said means for coupling also including apparatus coupling a lower portion of each bracing strut to an intermediate portion of its corresponding leg, in a position in which each strut extends upwardly and away from its leg, said mounting assemblies and coupling meanns being so configured, and disposed with respect to each other and to said beam, as to afford lateral clearance between the beam, legs, and struts sufficient to permit location of said assemblies, with their coupled legs and struts, at various positions along the length of said beam, and said coupling means further being adjustable, while substantially maintining said fixed distance, to accommodate arranagement of the bracing struts for the legs of both pairs in configurations either inboard or outboard of the legs thereof, or in configuration in which the bracing struts of one leg pair are arranged inboard and the bracing struts of the other leg pair are arranged outboard.

2. Apparatus in accordance with claim 1, and in which said bridging beam includes a generally vertical web having, at least along its upper edge, generally horizontal, laterally extending, flanging, and each mounting assembly comprises: spaced saddle structure overlying and slidably and frictionally embracing said flanging; and a pair of rods passing through and releasably secured to said saddle structure and establishing the spacing therebetween.

3. Apparatus in accordance with claim 2, and in which said coupling means includes: a plurality of rotatable members, one for each leg and strut, each said member being mounted for rotation upon one of said rods adjacent one said saddle structure, and carrying pin means disposed for releasable engagement with corresponding coupling means of each leg and strut.

4. Apparatus in accordance with claim 3, and in which the said corresponding coupling means, at the upper end of each strut, comprises a sleeve apertured to receive one of said pin means, and securable to its strut in either of two positions, one of said positions being such as to shorten the effective length of the strut as compared with its length in the other of said positions.

5. Apparatus in accordance with claim 2, and further including spring means reacting between the beam and each said rod, to stabilize the legs and struts of the gantry, when not under load, in a position in which the web of said beam is disposed generally centrally with respect to the diverging paired legs.

6. Apparatus in accordance with claim 1, in which the legs of one pair are splayed, with respect to the legs of the other pair, at a predetermined small angle measured lengthwise of the beam, and in which said coupling means includes an instrumentality adjustable to provide for changing the effective length of any strut, when coupled for outboard bracing, as compared with its effective length, when coupled for inboard bracing, whereby to maintain the splay angle in any of said configurations while maintaining said fixed distance.

7. Apparatus in accordance with claim 6, and in which said instrumentality comprises a sleeve carried by an upper end portion of the strut and adjustable in the direction of the length of the strut.

8. Apparatus in accordance with claim 6, and in which said instrumentality is disposed toward the lower end of the strut and provides two means for coupling the lower end of the strut to said corresponding leg, one of said latter means being utilizable, when the strut is coupled for outboard bracing, and serving to shorten the effective length of the strut.

9. Apparatus in accordance with claim 8, and in which said two means comprise two apertures provided at different regions along said strut.

10. Apparatus in accordance with claim 8, and in which said instrumentality is carried by said corresponding leg to be braced, and provides for securement of the lower end of the strut to the corresponding leg at either of two levels.

11. In a load-handling gantry, a flanged bridging bem in combination with leg, brace, and mounting components so supporting said beam as to provide adjustment of gantry span, height, and spread, and use of the gantry in a number of leg and brace configurations including inboard, outboard, and combination leg bracing, said components including: legs arranged in pairs with the legs of each pair spanning the beam and extending downwardly and diverging laterally of the beam; a bracing strut associated with and disposed to brace ech leg; a pair of mounting assemblies supported upon said beam and each comprising rod means, and a pair of securement means spaced along each rod means and carrying its associated rod means, each assembly extending in the direction of the length of the beam and movable therealong to vary the span between assemblies, the pair of securement means of each assembly including clamp structure extending across the flange of the beam and frictionally embracing the same to hold the assemblies in selected positions along the beam; and coupling means, in the region of said clamp structure, pinning upper end portions of the legs of a pair, and of the bracing strut for each such leg, to a corresponding one of said assemblies with freedom for pivotal leg and brace movements both longitudinally and laterally of the beam, and establishing, between the pinned end portions of each leg and its strut, a distance which is substantially fixed in each of said number of configurations.

12. Apparatus according to claim 11, and further characterized in that the clamp structure of each assembly is removable from frictional association with the beam flange, to accommodate selective end-to-end reversal of either assembly on the beam, and arrangement of the bracing struts for the legs of a pair of configurations either inboard or outboard of the legs of such pair.

* * * * *

UNITED STATES PATENT AND TRADEMARK OFFICE

CERTIFICATE OF CORRECTION

PATENT NO. : 4,041,875
DATED : August 16, 1977
INVENTOR(S) : Bernard E. Wallace

It is certified that error appears in the above-identified patent and that said Letters Patent are hereby corrected as shown below:

Col 1, line 32 - "beamm" should be -- beam --
line 58 - "is" should be --it--
Col 2, line 6 - "somewhhat" should be --somewhat--
" 12 - after "legs" insert --and--
Col 3, line 12 - "of" first occurrence should be --or--
Col 4, line 51 - "parisonn" should be --parison--

Col 6, line 5 - "bracking" should be --bracing--
" 49 - "illustrative" should be --illustrate--
" 54 - "secureed" should be --secured--
Col 7, line 57 - "struct" should be --strut--
Col 8, line 4 - "meanns" should be --means--
" 11 - "maintining" should be --maintaining--
" 12 - "arranagement"shoul be --arrangement"
Col 9, line 9 - "bem" should be --beam--
" 18 - "ech" should be --each--

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*